US008213665B2

(12) United States Patent
Fujiwara et al.

(10) Patent No.: US 8,213,665 B2
(45) Date of Patent: Jul. 3, 2012

(54) HEADPHONE

(75) Inventors: Keitaro Fujiwara, Tokyo (JP); Naotaka Tsunoda, Tokyo (JP); Yuusuke Oosato, Tokyo (JP)

(73) Assignee: Sony Corporation, Tokyo (JP)

( * ) Notice: Subject to any disclaimer, the term of this patent is extended or adjusted under 35 U.S.C. 154(b) by 1344 days.

(21) Appl. No.: 11/846,282

(22) Filed: Aug. 28, 2007

(65) Prior Publication Data

US 2008/0056525 A1 Mar. 6, 2008

(30) Foreign Application Priority Data

Sep. 6, 2006 (JP) ..... P2006-241703

(51) Int. Cl.
*H04R 25/00* (2006.01)

(52) U.S. Cl. ..... 381/374

(58) Field of Classification Search ..... 381/374, 381/377, 379

See application file for complete search history.

(56) References Cited

U.S. PATENT DOCUMENTS

| | | | | |
|---|---|---|---|---|
| 3,919,501 | A * | 11/1975 | Cech et al. | 381/379 |
| 4,409,442 | A * | 10/1983 | Kamimura | 381/383 |
| 4,689,822 | A * | 8/1987 | Houng | 381/379 |

FOREIGN PATENT DOCUMENTS

| | | |
|---|---|---|
| JP | 62-053688 | 4/1987 |
| JP | 62-53888 | 4/1987 |
| JP | 62-53889 | 4/1987 |
| JP | 62-053889 | 4/1987 |
| JP | 05-308694 | 11/1993 |
| JP | 06-113385 | 4/1994 |
| JP | 08-256390 | 10/1996 |
| JP | 08-256391 | 10/1996 |
| JP | 10-174187 | 6/1998 |
| JP | 2000-125386 | 4/2000 |
| JP | 2002-247677 | 8/2002 |
| JP | 3520531 | 2/2004 |

OTHER PUBLICATIONS

Communication and Search Report from the Japanese Patent Office, dated Oct. 10, 2008, for Application No. 2006-241703, 5 pages.
Notification of Reasons for Refusal for Patent Application No. 2008-322629, Sep. 3, 2010 from the Japanese Patent Office.

* cited by examiner

*Primary Examiner* — Jeffrey Donels
(74) *Attorney, Agent, or Firm* — Finnegan, Henderson, Farabow, Garrett & Dunner, L.L.P.

(57) ABSTRACT

A headphone includes a headband and a left housing and a right housing. The left housing and the right housing are mounted to respective ends of the headband through respective hangers. Each housing accommodates a drive unit. Sliders including hollow cylindrical members are mounted to the respective hangers, and are slidably supported at slidably supporting portions at the respective ends of the headband. A cord, disposed between the left and right housings and used to pass drive electric current to the drive unit in one of the housings, is spirally accommodated in the hollow cylindrical members making up the respective sliders so that the cord is capable of being stretched and compressed.

7 Claims, 13 Drawing Sheets

HEADPHONE

CROSS REFERENCES TO RELATED APPLICATIONS

The present invention contains subject matter related to Japanese Patent Application JP 2006-241703 filed in the Japanese Patent Office on Sep. 6, 2007, the entire contents of which are incorporated herein by reference.

BACKGROUND OF THE INVENTION

1. Field of the Invention

The present invention relates to a headphone, and, more particularly, to a headphone having left and right housings, which accommodate drive units, mounted at respective ends of a headband through hangers.

2. Description of the Related Art

To, for example, enjoy music while preventing sound from leaking to the outside, a headphone has hitherto been widely used. In general, a headphone has a structure in which left and right housings are mounted to respective ends of a headband through hangers. In the housings, drive units including small speakers are disposed. Therefore, by passing electric current through voice coils of the drive units, sound is reproduced by the drive units.

Accordingly, to supply sound signals to the respective drive units in the left and right housings, a cord is connected to the drive units in the left and right housings. Here, the following two methods are available as methods of drawing out a cord of a headphone. In the first method, cords are separately drawn out from the left and right housings. In the second method, a cord at the right housing is passed through the headband and is led into the left housing, and a cord that supplies driving current to the left and right drive units is aligned to draw out the resulting cord from the left housing. A user may feel that the first method is troublesome and causes discomfort because two cords, that is, the left and right cords, are drawn out to a neck. In contrast, in the second method, one combined cord is drawn out from the left housing, so that the user can feel that the second method is less troublesome.

However, the second method, in which the cord that is connected to the drive unit in the right housing is passed through the headband and is connected to the left housing, uses a mechanism for performing stretching/compressing adjustments on the cord in accordance with an adjusting operation of a stretching/compressing mechanism for adjusting the distance between each housing and the headband. As such a stretching/compression mechanism, for example, a structure in which the cord is bent and accommodated in an intermediate slider case or the like is proposed, in addition to a structure using a method in which the cord is exposed directly to the outside. FIG. 1 shows the structure in which the cord is exposed to the outside. Here, a housing 1, which accommodates a drive unit, is rotatably mounted to a hanger 2. In addition, a slider 3, mounted to the hanger 2, is slidably connected to a slide hole of a slidably supporting portion 5 attached to ends of headbands 4.

Slidably adjusting the slider 3 with respect to the slidably supporting portion 5 makes it possible to adjust the distance between each headband 4 and the housing 1. In this case, an excessive portion of a cord 6 is exposed so as to project sideways. That is, the stretching/compressing structure is achieved as a result of changing the amount of projection of the cord 6 that is bent and projected.

In the stretching/compressing structure of the cord 6 shown in FIG. 1, as is clear from FIG. 1, the cord 6 is exposed sideways, and the cord 6 moves freely at this portion. Therefore, for example, the cord 6 may break due to external shock, or may be caught by a different member.

FIGS. 2A and 2B show a headphone in which an excessive portion of a cord 6 is bent and accommodated in a slider case 8. That is, a slider 3 is connected to the lower end of a headband 4, and is slidable with respect to the slider case 8 connected to the upper end of a hanger 2.

Therefore, as shown in FIG. 2A, when an adjustment is made so that a housing 1 approaches the headband 4, the excessive portion of the cord 6 is held in a bent state in the slider case 8. In contrast, as shown in FIG. 2B, when the housing 1 is moved away downward from the headband 4, the slider 3 is moved out upward from the slider case 8, so that the cord 6, connected to the slider 3, is also drawn out from the slider case 8.

In the structure shown in FIGS. 2A and 2B in which the cord 6 is bent and held in the slider case 8, when the slider case 8 that causes the cord 6 to be formed in a U shape is too small, the cord 6 is too short when the slider 3 is drawn out by a large amount. Therefore, the cord 6 breaks. Consequently, the slider case 8 that bends and holds the cord 6 needs to be made long to a certain extent in a vertical direction. As a result, the relatively large slider case 8 needs to be provided, thereby preventing the headphone from becoming compact.

Further, for example, Japanese Patent No. 3520531 discusses the following headphone. In the headphone, a cord is disposed in a holding groove of a headband so as not to be capable of being stretched and compressed. In addition, a housing is mounted to the headband so as not be adjustable. Further, a head cushion is mounted to the lower side of the headband so that an actual height is adjusted by the head cushion.

In this structure, even when the head cushion is maximally stretched, the head cushion must not interfere with the headband. Therefore, the headband becomes large, resulting in the problem that a portion that is mounted to a head becomes disproportionately large. In addition, since the portion that is mounted to the head includes two components, the headband and a suspender constituting the head cushion, the number of components is increased, thereby increasing weight.

SUMMARY OF THE INVENTION

It is desirable to provide a headphone in which an excessive portion of a cord is not exposed to the outside, when a housing, which accommodates a drive unit, is brought close to a headband as a result of adjusting the position of the housing.

It is also desirable to provide a headphone which does not use a slider case for accommodating an excessive portion of a cord, when a housing is moved so as to approach a headband.

It is further desirable to provide a headphone in which a suspender or a head cushion is not used along with a headband as a portion that is mounted to a head.

It is further desirable to provide a headphone in which an excessive portion of a cord is compactly held without being exposed to the outside, when a housing is adjusted so as to approach a headband.

These points and other points will be clarified on the basis of the technical ideas and embodiments according to the invention of the application described below.

According to an embodiment of the present invention, there is provided a headphone including a headband and a left housing and a right housing. The left housing and the right housing are mounted to respective ends of the headband through respective hangers. Each housing accommodates a drive unit. Sliders including hollow cylindrical members are mounted to the respective hangers, and are slidably supported at slidably supporting portions at the respective ends of the headband. A cord, disposed between the left and right housings and used to pass drive electric current to the drive unit in one of the housings, is spirally accommodated in the hollow cylindrical members making up the respective sliders so that the cord is capable of being stretched and compressed.

In one form, the sliders have draw-out grooves extending in an axial direction thereof, and the spirally accommodated cord is drawn out through the draw-out grooves. In another form, the headband has a holding groove, and first end portions of the cord are drawn out from the draw-out grooves in the slidably supporting portions and are disposed in the holding groove of the headband. In still another form, a lower end portion of each slider is rotatably connected to an upper end of the corresponding hanger by a corresponding bearing, the hangers have holding grooves, and second end portions of the cord are drawn out from inside rotating cylindrical members and are disposed in the holding grooves of the respective hangers. The rotating cylindrical members are mounted to the lower ends of the sliders so as to constitute the bearings and so that axial lines thereof are perpendicular to the sliders. In still another form, each slidably supporting portion has a pawl, and the pawls engage the draw-out grooves to prevent rotation of the sliders. Here, when the sliders are slid in the respective slidably supporting portions so that a headband-to-hanger distance is reduced, the pawls axially compress the cord spirally accommodated in the sliders.

According to another embodiment of the present invention, there is provided a headphone including a headband and a left housing and a right housing. The left housing and the right housing are mounted to respective ends of the headband through respective hangers. Each housing accommodates a drive unit. Rod sliders are mounted to the respective hangers, and are slidably supported at slidably supporting portions at the respective ends of the headband. A cord, disposed between the left and right housings and used to pass drive electric current to the drive unit in one of the housings, is spirally wound upon outer peripheral surfaces of the rod sliders so that the cord is capable of being stretched and compressed.

In one form, the rod sliders are bent into U shapes, and U-shaped bent ends of the respective sliders are slidably supported by the respective slidably supporting portions. In addition, each slider has two separated end portions opposite to the corresponding U-shaped bent end, and the two separated end portions of each slider opposite to the corresponding U-shaped bent end are connected to upper ends of the respective hangers. In another form, upper ends of the cord wound upon the rod sliders are drawn into the slidably supporting portions, and are stopped at the slidably supporting portions by stopping units. In still another form, the stopping units are stopping pins, and the drawn out cord is bend so as to extend around the stopping pins in the slidably supporting portions. In still another form, the hangers have holding grooves, and lower ends of the cord wound upon the rod sliders are drawn out to draw-out guides and are disposed in the holding grooves of the hangers.

According to a desirable form of the invention of the application, a headphone including a headband length adjusting mechanism is such that a portion of a wire cord, disposed for electrically connecting the left and right housings, is substantially coiled, and the coiled portion is made resilient in an axial direction. In addition, in an expanded form, the headphone includes a headband length adjusting mechanism including a pair of sliding tubular members and supporting mechanisms. The coiled wire cord is accommodated in the tubular members, and follows the sliding of the tubular members as result of making use of the axial resiliency of the wire cord. Alternatively, the headphone includes a headband adjusting mechanism including a pair of sliding rods and supporting mechanisms. In addition, in this headphone, the coiled wire cord is disposed so as to be wound upon the rod, and follows the sliding of the rod in a rod sliding direction as a result of making use of the axial resiliency of the wire cord.

According to the above-described form, the coiled cord is disposed in the tubular sliders, and follows the sliding of the sliders. Therefore, the cord is compactly disposed so that it is no longer exposed to the outside. As a result, the headphone also has a structure that prevents breakage of the cord caused by external shock. In the structure in which the coiled cord is wound upon one of the rod sliders, the cord is exposed to the outside, but the position of the cord is restricted by the slider, and the cord follows the sliding of the slider. Therefore, it is possible to more reliably prevent the cord from breaking, and to make the headphone structure compact.

A primary feature of the invention of the application is a headphone including a headband and a left housing and a right housing. The left housing and the right housing are mounted to respective ends of the headband through respective hangers. Each housing accommodates a drive unit. Sliders including hollow cylindrical members are mounted to the respective hangers, and are slidably supported at slidably supporting portions at the respective ends of the headband. A cord, disposed between the left and right housings and used to pass drive electric current to the drive unit in one of the housings, is spirally accommodated in the hollow cylindrical members making up the respective sliders so that the cord is capable of being stretched and compressed.

Accordingly, according to the headphone, when the sliders for adjusting mounting positions of the housings with respect to the headband are slidably adjusted with respect to the slidably supporting portions, stretching/compression adjustments are performed on the cord, disposed between the left and right housings, in the cylindrical members constituting the sliders. By this, the length of the cord is adjusted. Therefore, a member, such as a slider case, that absorbs the length of an excessive portion of the cord is no longer used.

Another primary feature of the invention of the application is another headphone including a headband and a left housing and a right housing. The left housing and the right housing are mounted to respective ends of the headband through respective hangers. Each housing accommodates a drive unit. Rod sliders are mounted to the respective hangers, and are slidably supported at slidably supporting portions at the respective ends of the headband. A cord, disposed between the left and right housings and used to pass drive electric current to the drive unit in one of the housings, is spirally wound upon outer peripheral surfaces of the rod sliders so that the cord is capable of being stretched and compressed.

Accordingly, according to the headphone, when the sliders for adjusting mounting positions of the housings with respect to the headband are slidably adjusted at the slidably supporting portions, the cord, which is spirally wound upon the outer peripheral surfaces of the rod sliders is stretched and compressed, so that it is possible to make changes in the length of the cord. Consequently, the cord no longer considerably projects sideways from the outer peripheral surfaces of the rod sliders, or projects on the rod sliders.

DESCRIPTION OF THE PREFERRED EMBODIMENTS

Figure 1:
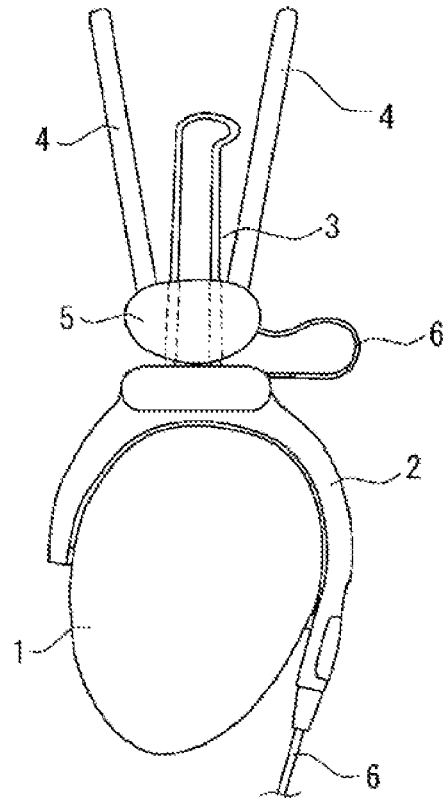
FIG. 1 is a side view of a structure of a related headphone.
Figure 2A:
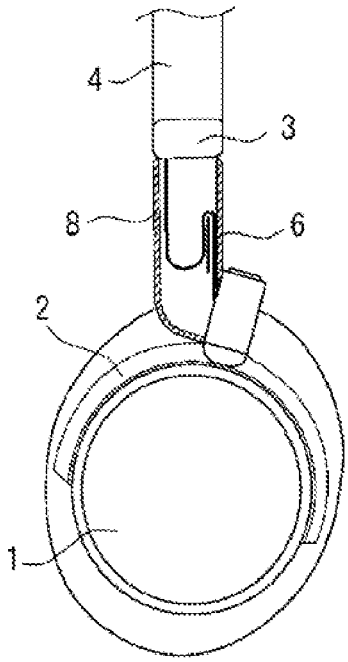
FIGS. 2A and 2B are side views of a structure of a related headphone including a slider case.
Figure 2B:
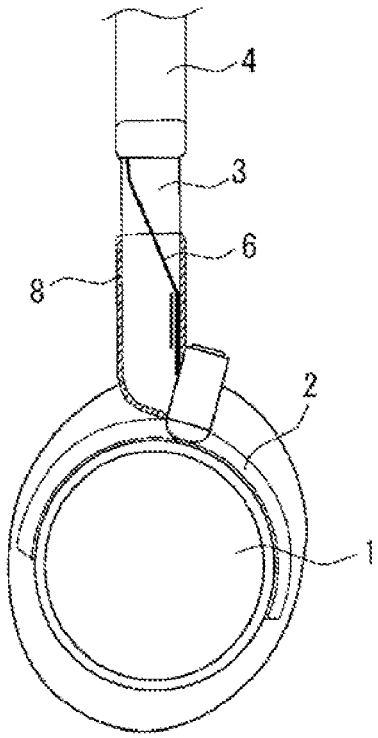
Figure 3:
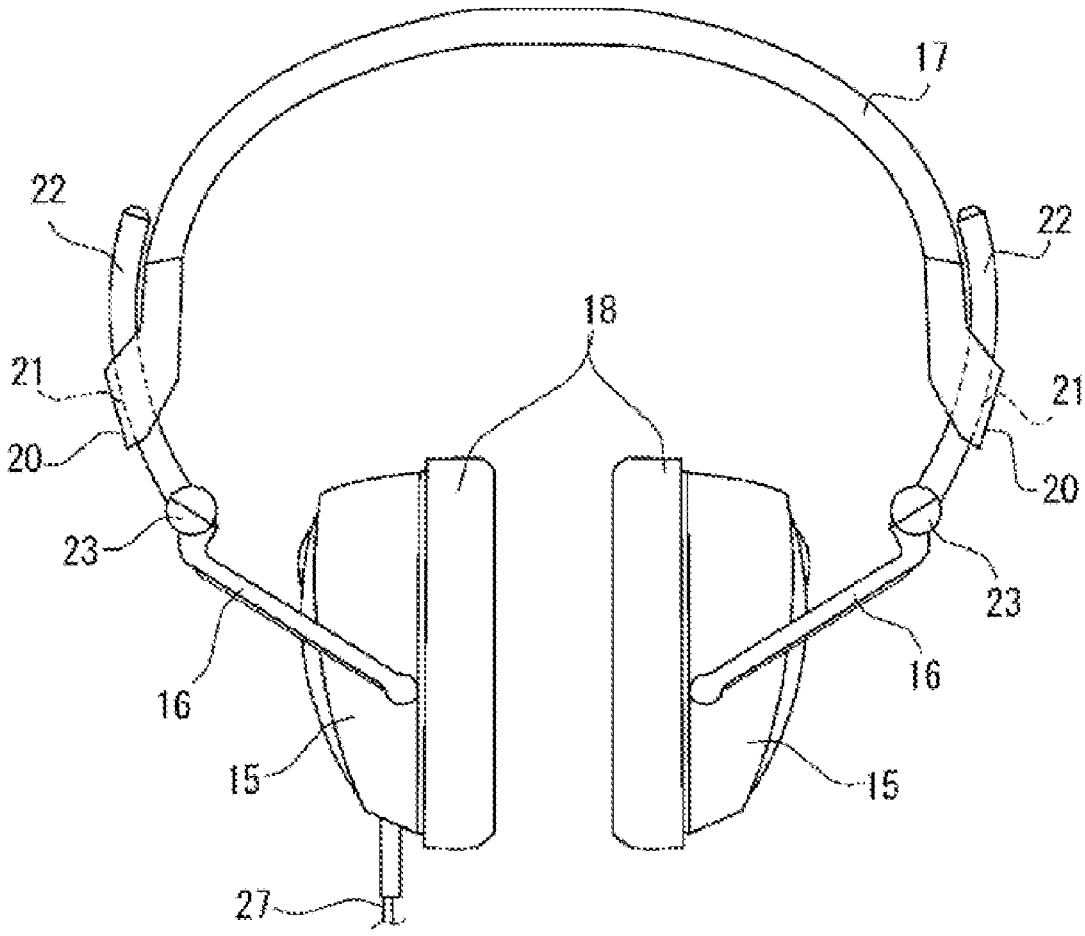
FIG. 3 is a front view of a headphone according to a first embodiment of the present invention.
Figure 4:
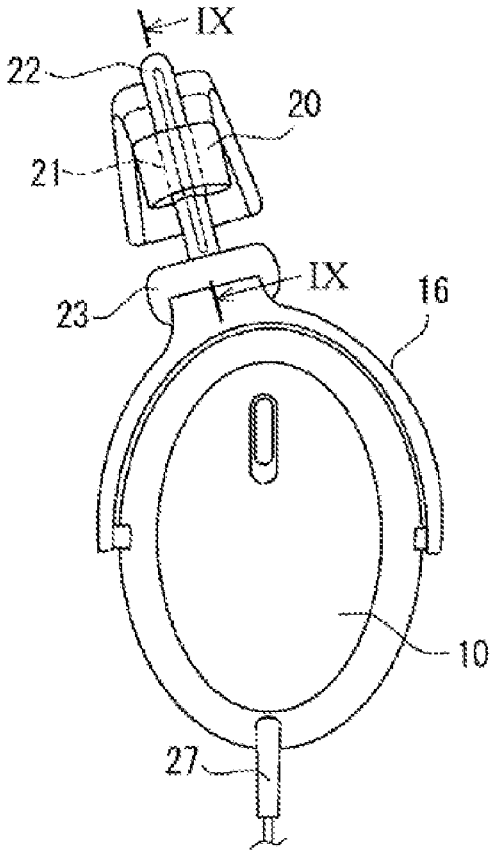
FIG. 4 is a side view of the headphone.

The invention of the application will hereunder be described with reference to illustrated embodiments. First, a first embodiment will be described. FIGS. 3 and 4 show an entire structure of a headphone according to the first embodiment. The headphone includes a pair of left and right housings 15. Baffle plates are mounted in the housings 15 so as to close the entrances of the housings 15. Drive units including small speakers are mounted to inner sides of the respective baffle plates. When signal electric current passes through voice coils of the drive units, sound is reproduced on the basis of the same principle as that of a speaker. The housings 15 are rotatably connected to respective hangers 16, and are mounted to a headband 17 through the respective hangers 16. Ear pads 18 are mounted to inner peripheral portions of the respective housings 15.

Figure 5:
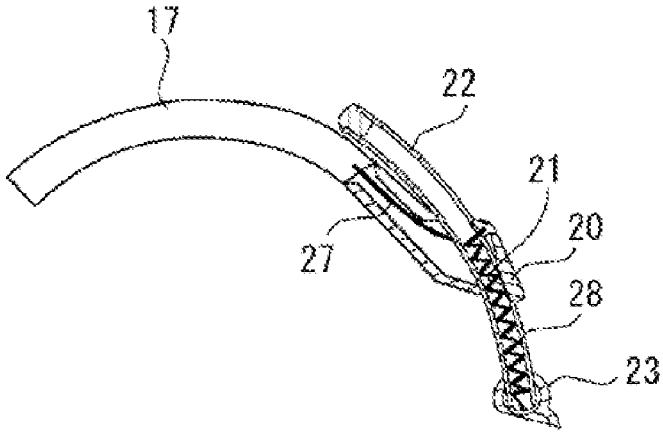
FIG. 5 is a vertical sectional view of a sliding mechanism of a slider of the headphone.
Figure 6:
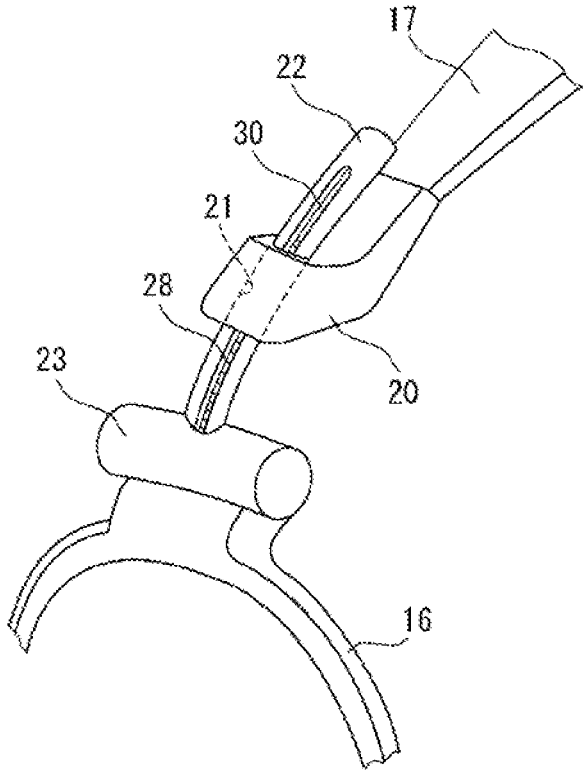
FIG. 6 is a perspective view of the sliding mechanism of the slider.

Here, adjusting mechanisms for adjusting the positions of the housings 15 and the headband 17 relative to each other are provided. As shown in FIGS. 5 and 6, the adjusting mechanisms include slidably supporting portions 20 mounted to respective ends of the headband 17, and slidably support sliders 22 at slide holes 21 of the respective slidably supporting portions 20. The sliders 22 are rotatably supported at the upper ends of the respective hangers 16, which rotatably support the housings 15, by rotating bearings 23.

Figure 7:
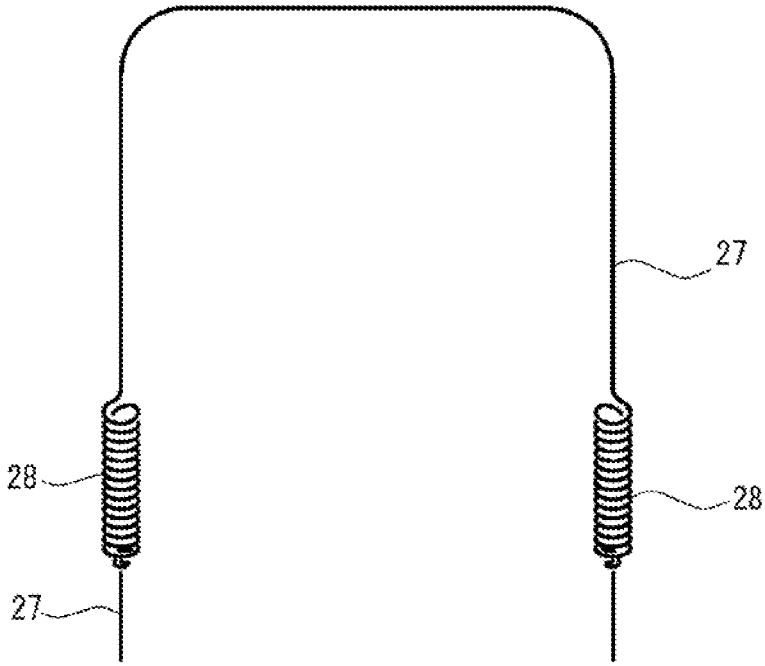
FIG. 7 is a front view of a cord form.

Curled portions 28 of a cord 27, disposed in a holding groove 31 of the headband 17 and used to supply signal electrical current to the drive unit in the right housing 15 through the left housing 15, are spirally accommodated and held in the sliders 22. That is, as shown in FIG. 7, the cord 27 has the curled portions 28 near respective ends thereof. The curled portions 28 are spirally accommodated in the sliders 22. As shown in FIG. 8, rotating cylindrical members 29 are connected to the lower ends of the respective sliders 22, and the sliders 22 are rotatably supported at the rotating cylindrical members 29 by the rotating bearings 23.

Draw-out grooves 30 extending axially in outer surfaces of the sliders 22 are formed in the respective sliders 22, rotatably connected by the rotating bearings 23 at the hangers 16. The cord 27 is drawn out through the draw-out grooves 30. Portions of the cord 27 at the upper sides of the curled portions 28 are drawn out from the sliders 22, and, then, passed into the slidably supporting portions 20, so that they are disposed in the holding groove 31 of the headband 17 (see FIG. 9). Portions of the cord 27, disposed at the lower end sides of the sliders 22 and drawn out from the rotating bearings 23 through the rotating bearings 29, are disposed in holding grooves 32 of the hangers 16.

Figure 8A:
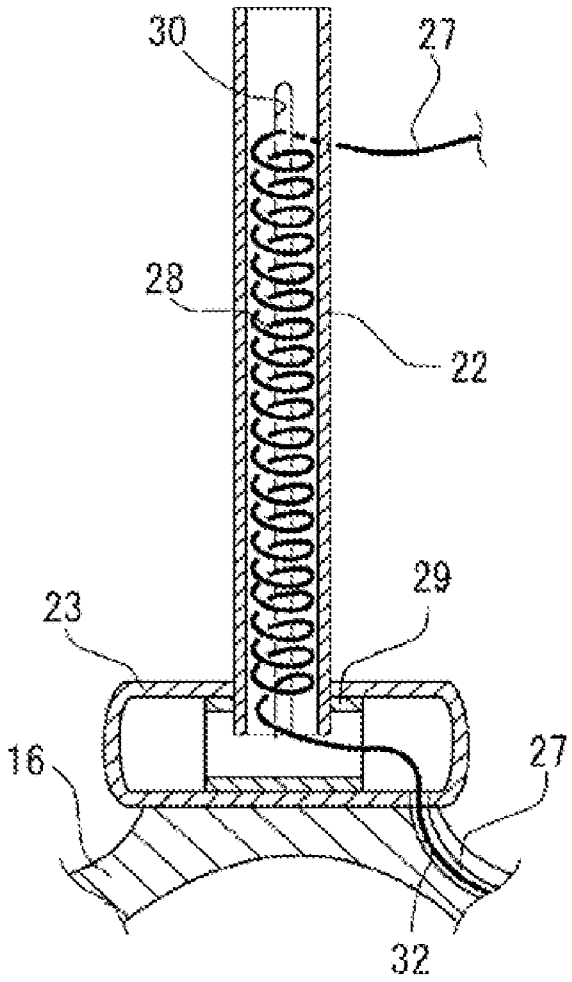
FIGS. 8A and 8B are a vertical sectional view and an enlarged horizontal sectional view of the cord form in the slider.
Figure 8B:
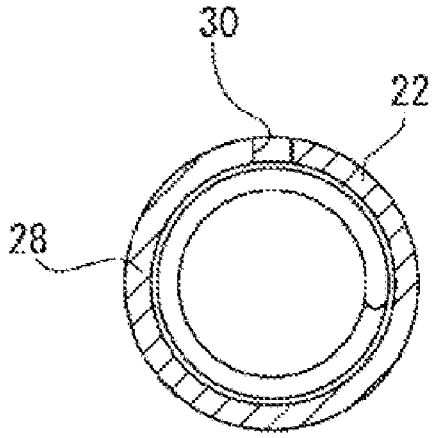
Figure 9A:
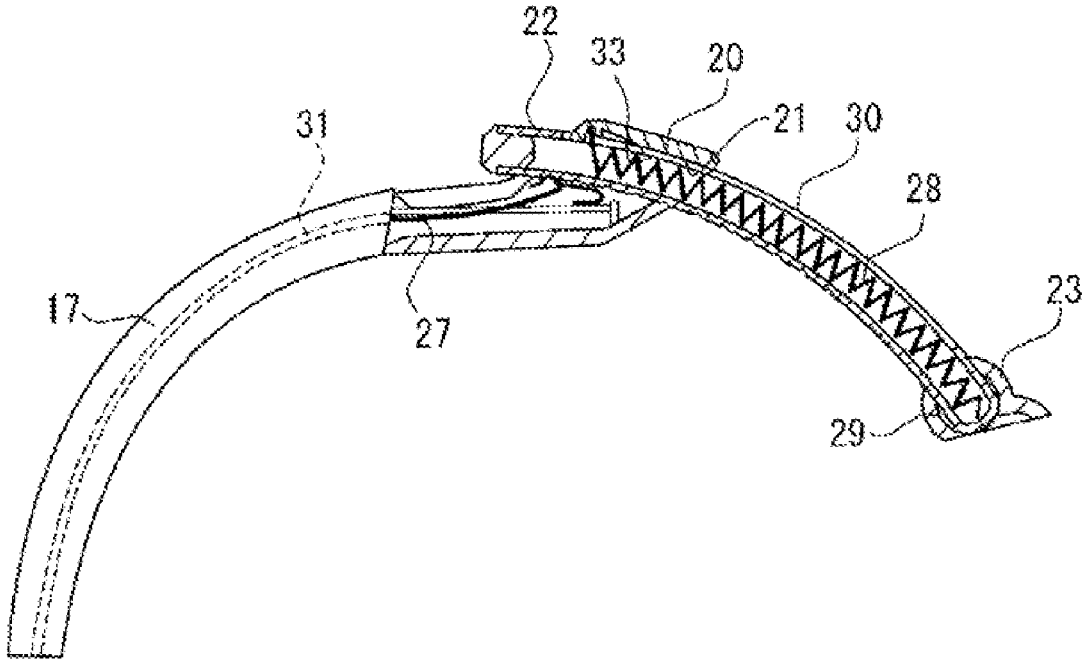
FIGS. 9A and 9B are side views of a main portion of a structure, showing sliding of the slider.
Figure 9B:
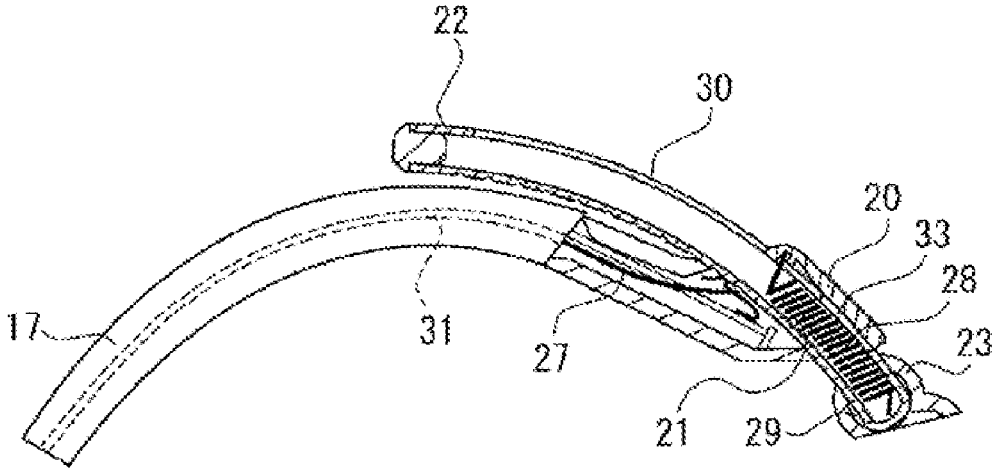

Accordingly, in the headphone according to the embodiment, as shown in FIG. 7, the cord 27 has the curled portions 28 at the respective ends of the cord 27, and, as shown in FIGS. 8A and 8B, the curled portions 28 are spirally accommodated in the left and right sliders 22 so that the curled portions 28 are capable of being stretched and compressed. Therefore, when, as shown in FIG. 9A (which is a sectional view taken along line IX-IX in FIG. 4 when the headband 17 is extended), the sliders 22 are drawn out from the respective slidably supporting portions 20, the curled portions 28 of the cord 27 in the hollow sliders 22 are stretched. In contrast, when the sliders 22 are pushed into the slidably supporting portions 20 at the headband 17, as shown in FIG. 9B (which is a sectional view taken along line IX-IX in FIG. 4 when the headband 17 is contracted), the curled portions 28 of the cord 27 are compressed.

When the distance between each housing 15 and the headband 17 is adjusted by sliding the corresponding slider 22, the problem that an excessive portion or an insufficient portion results from adjusting the length of the cord 27 can be solved by stretching or compressing each curled portion 28 in the corresponding hollow slider 22. In addition, such a structure can prevent exposure of the cord 27 to the outside when it is being stretched or compressed, so that it can prevent breakage of the cord caused by external shock. Further, even if the cord 27 is sufficiently drawn out, since the spiral forms of the curled portions 28 of the cord 27 are adequately maintained in the respective sliders 22, it is possible to prevent breakage of the cord 27 or the curled portions 28 caused by application of tension on the cord 27 or the curled portions 28.

When listening to music using such a headphone, as mentioned above, the lengths by which the sliders 22 are drawn out from the slidably supporting portions 20 are adjusted, so that the heights of the housings 15 with respect to the headband 17 are adjusted, thereby adjusting the housings 15 to their proper positions. In such a state, the headphone is placed on a head, and signal electrical current is supplied through the cord 27. When the signal electrical current is supplied, the signal electrical current is supplied not only to the drive unit in the left housing 15, but also to the drive unit in the right housing 15, so that the drive units in the respective housings 15 reproduce sound. This makes it possible for a person to, for example, enjoy music.

Next, a modification of the embodiment will be described with reference to FIGS. 10 and 11. In this modification, a sliding pawl 36 is disposed in each slidably supporting portion 20 supporting the corresponding slider 22. As shown in FIG. 11, each sliding pawl 36 includes a projection 37 at the top surface thereof, and a projecting portion 38 is formed at one side of each projection 37 so as to project upward therefrom. Each projection 37 has a draw-out hole 39. Each draw-out groove 40, connected to the corresponding draw-out hole 39, opens at a side of the corresponding sliding pawl 36.

Accordingly, the sliding pawls 36 are disposed in the respective slidably supporting portions 20, and the projections 37 of the sliding pawls 36 engage the respective draw-out grooves 30. This results in the projecting portions 38 of the sliding pawls 36 projecting into the respective sliders 22. The sliders 22 are prevented from rotating with respect to the slidably supporting portions 20 by the projections 37 and the projecting portions 38 of the respective sliding pawls 36.

Figure 10:
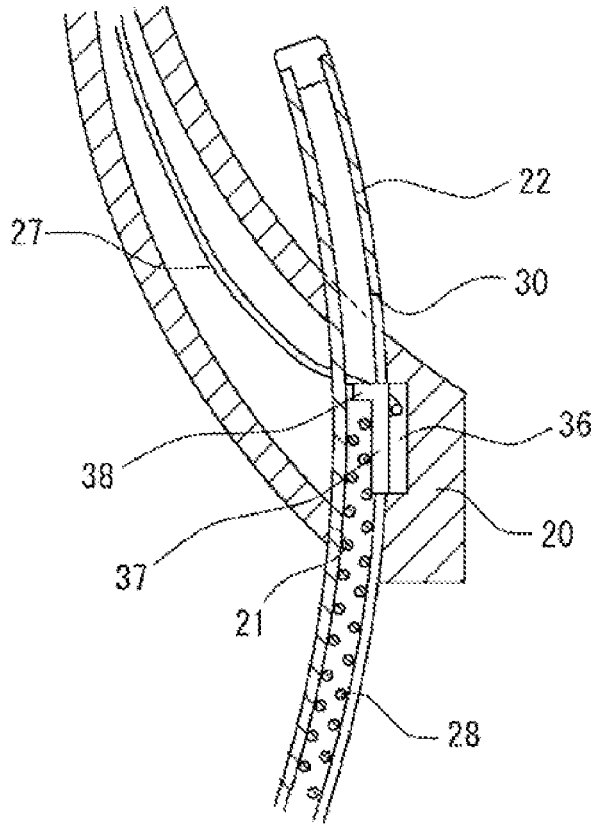
FIG. 10 is an enlarged sectional view of a main portion of a sliding mechanism of a slider according to a modification including a sliding pawl.
Figure 11:
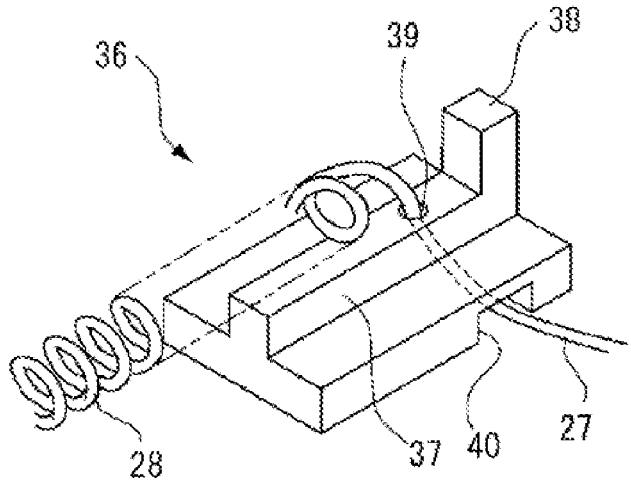
FIG. 11 is an enlarged perspective view of the sliding pawl.

Therefore, according to such a structure, as shown, in particular in FIG. 10, when the sliders 22 are considerably pushed into the slidably supporting portions 20, the projecting portions 38 of the sliding pawls 36 push the upper ends of the spiral portions, accommodated in the sliders 22, of the curled portions 28 of the cord 27. This, in particular, helps compress the curled portions 28 of the cord 27 in the sliders 22, so that the curled portions 28 are effectively compressed. The upper end sides of the cord 27, formed continuously with the curled portions 28, are drawn out sideways through the draw-out grooves 40 from the draw-out holes 39 of the sliding pawls 36, pass into the slidably supporting portions 20, and are disposed in the holding groove 31 of the headband 17.

Next, another modification will be described with reference to FIGS. 12A and 12B. In a structure according to the modification, cylindrical members 46 are mounted to respective ends of the headband 17 through connecting portions 48, intermediate cylindrical members 45 (which are one size smaller than the cylindrical members 46) are slidably disposed with respect to the cylindrical members 46, and small cylindrical members 44 are slidably disposed in the cylindrical members 45. Here, the small innermost cylindrical members 44 are rotatably connected to the upper ends of the hangers 16 through the rotating bearings 23.

Figure 12A:
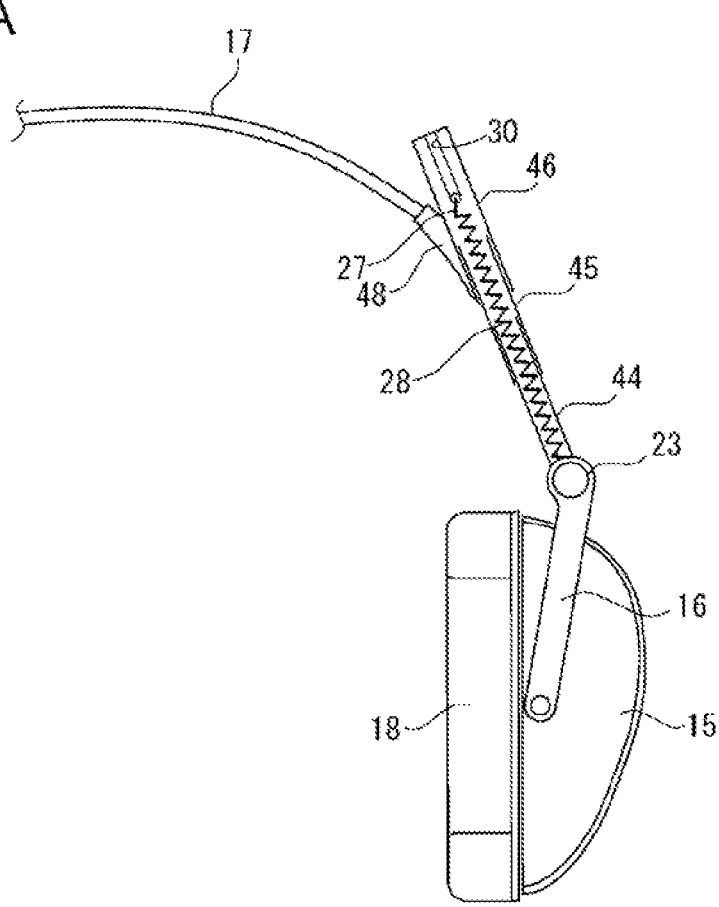
FIGS. 12A and 12B are front views of a main portion of a structure according to a modification including a sliding mechanism including three cylindrical members.

Accordingly, when the housings 15 are separated from the headband 17 by a large distance, as shown in FIG. 12A, the intermediate cylindrical members 45 are drawn out downward from the large cylindrical members 46, mounted to the headband 17 through the connecting portions 48. Then, also as shown in FIG. 12A, the small cylindrical members 44 at the lower end sides are drawn out from the intermediate cylindrical members 45. Therefore, here, the large outer cylindrical members 46 constitute slidably supporting portions with respect to the intermediate cylindrical members 45, and the intermediate cylindrical members 45 constitute slidably supporting portions with respect to the cylindrical members 44 at the front end sides.

Figure 12B:
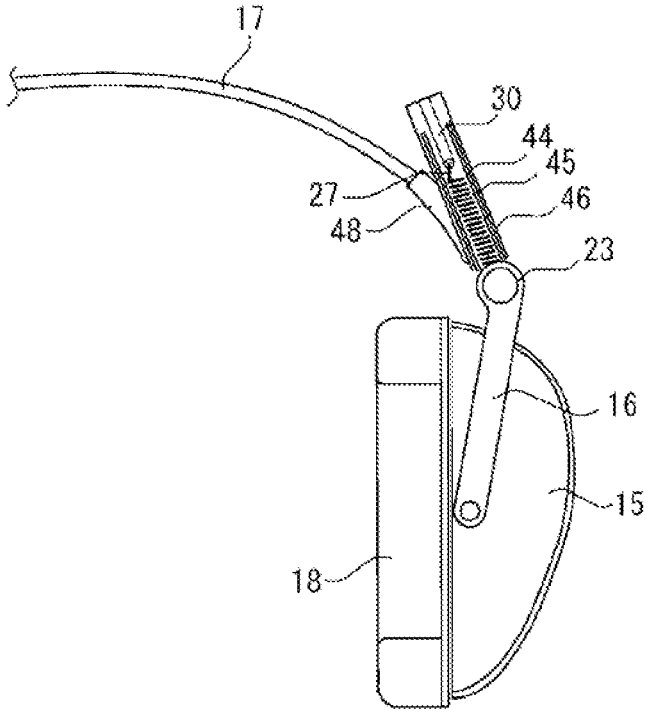

When the housings 15 are disposed close to the headband 17, as shown in FIG. 12B, the small cylindrical members 44 at the lower sides are accommodated in the intermediate cylindrical members 45, and the intermediate cylindrical members 45 are accommodated in the large cylindrical members 46 at the outer sides. Here, relative accommodation amounts of the three types of cylindrical members 44, 45, and 46 are adjusted to make it possible to adjust the heights of the housings 15 with respect to the headband 17 to any heights.

Moreover, during such an adjustment, the curled portions 28 of the cord 27 are spirally accommodated in the innermost cylindrical members 44 so as to be capable of being stretched and compressed. Further, as is clear from FIGS. 12A and 12B, since the stretching and compression amounts of the curled portions 28 are properly set in accordance with the relative extending and contracting amounts of the three types of cylindrical members 44 to 46, the length of the cord 27 is thereby adjusted. In addition, here, the cord 27 is not exposed to the outside.

Figure 13:
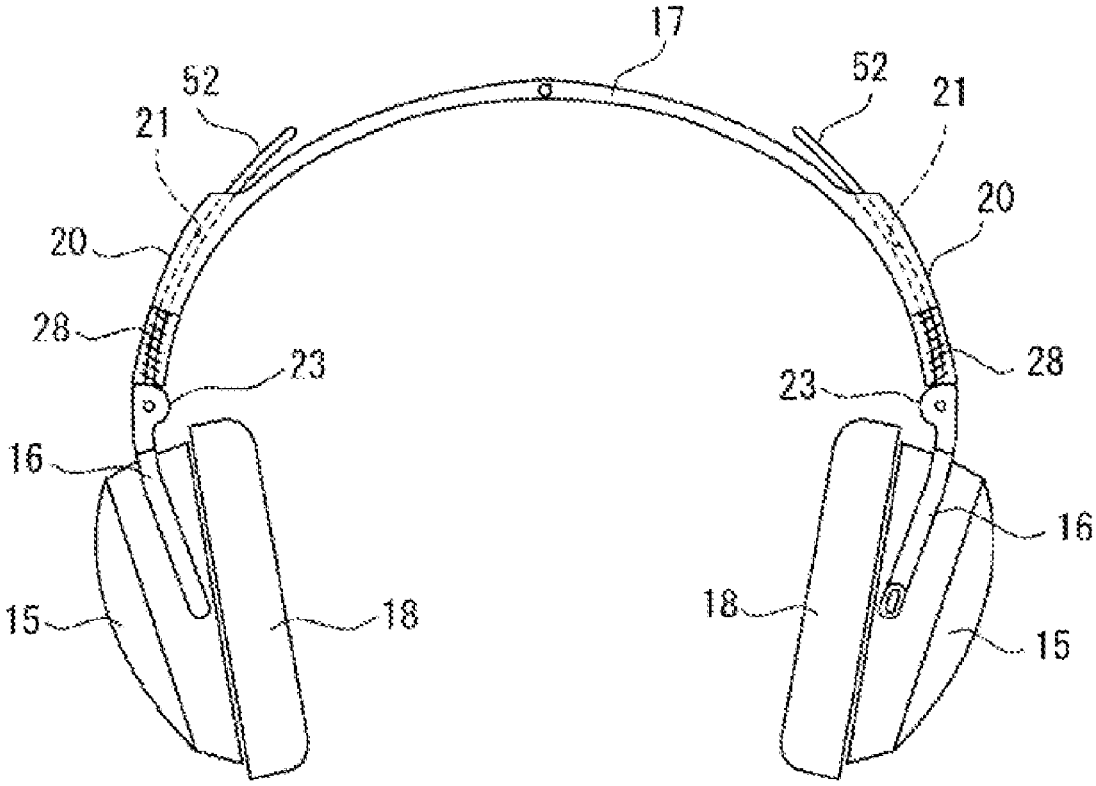
FIG. 13 is a front view of a headphone according to a second embodiment of the present invention.
Figure 14:
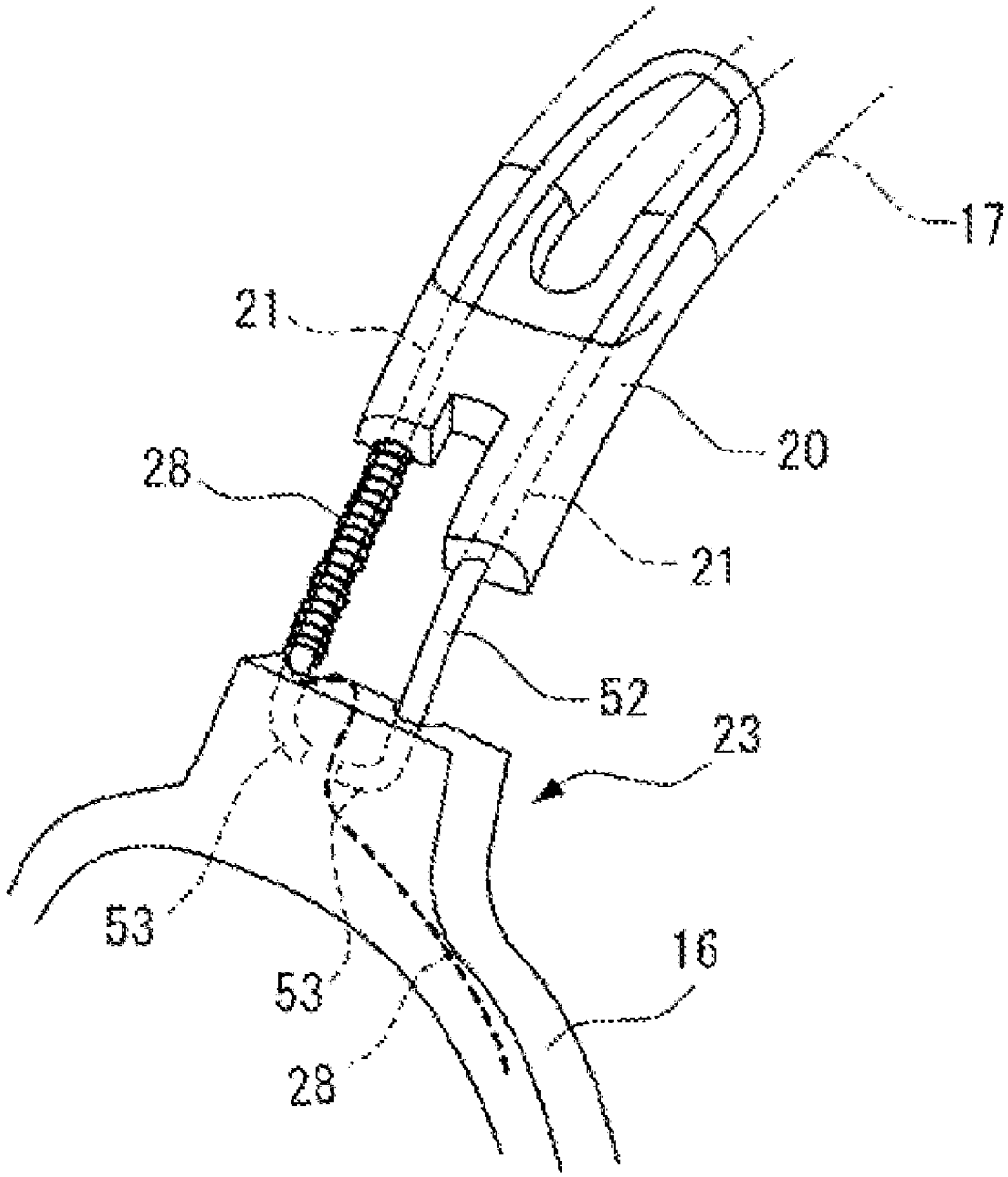
FIG. 14 is a perspective view of a main portion of a sliding mechanism of a slider of the headphone.
Figure 15A:
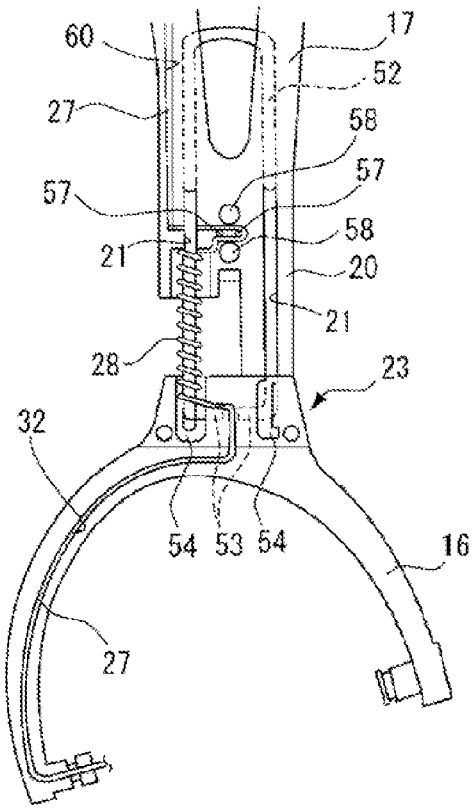
FIGS. 15A and 15B are enlarged side views illustrating sliding of the slider.
Figure 15B:
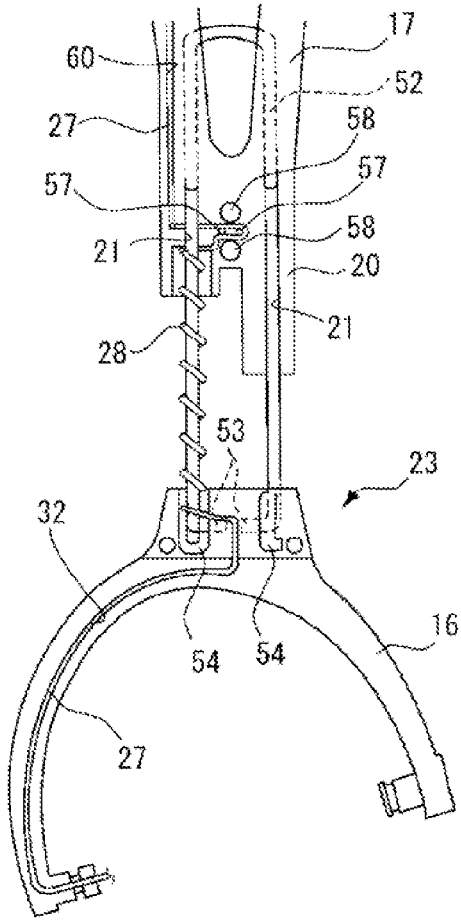

Next, another embodiment of the present invention will be described with reference to FIGS. 13 to 15. In this embodiment, instead of the sliders 22 including hollow cylindrical members, U-shaped sliders 52 are used to adjust the distances of a headband 17 from respective housings 15. Upper-end bent portions of the sliders 52 are slidably supported in slide holes 21 of slidably supporting portions 20, connected to respective ends of the headband 17, and two lower-end portions of each slider 52 are bent towards each other to form bent portions 53. As shown in FIGS. 15A and 15B, such bent portions 53 are inserted in bearing ribs 54 at the upper ends of hangers 16, so that the lower ends of the sliders 52 are rotatably connected to the upper ends of the respective hangers 16. Such a structure can achieve functions comparable to those of the rotational connection structure according to the first embodiment.

Each curled portion 28 of a cord 27 for transmitting a signal between the left and right housings 15 is spirally wound upon an outer peripheral surface of one of the rods making up each slider 52. Here, the curled portions 28 of the cord 27 can be stretched and compressed at the sliders 52.

As shown in FIGS. 15A and 15B, each portion of the cord 27 at the upper end side of the corresponding curled portion 28 is stopped by a pair of stopping pins 57 and a pair of projecting portions 58, formed in the corresponding slidably supporting portion 20. The ends of the cord 27, which are stopped by the stopping pins 57 and the projecting portions 58, are drawn out upward, and are held in a holding groove 60 of the headband 17. In contrast, each portion of the cord 27 at the lower end side of the corresponding curled portion 28 is drawn out from the bent portions 53 at the respective sides of the corresponding slider 52, and is disposed in a holding groove 32, formed inside the corresponding hanger 16.

In such a structure described above, when the heights of the housings 15 with respect to the headband 17 are adjusted, as shown in FIGS. 15A and 15B, the sliders 52 are moved with respect to the slidably supporting portions 20. Here, at one of the rods making up each slider 52, each curled portion 28 of the cord 27 is compressed as shown in FIG. 15A, or is stretched as shown in FIG. 15B. Therefore, the length of the cord 27, which is based on the movement of each slider 22, can be absorbed by stretching and compressing each curled portion 28. Even during the stretching and compression of each curled portion 28, each curled portion 28 of the cord 27 does not project to the outside by a large amount, or is not pulled so as to be tensioned more than is necessary. Therefore, breakage of the cord 27 is prevented from occurring.

Figure 16:
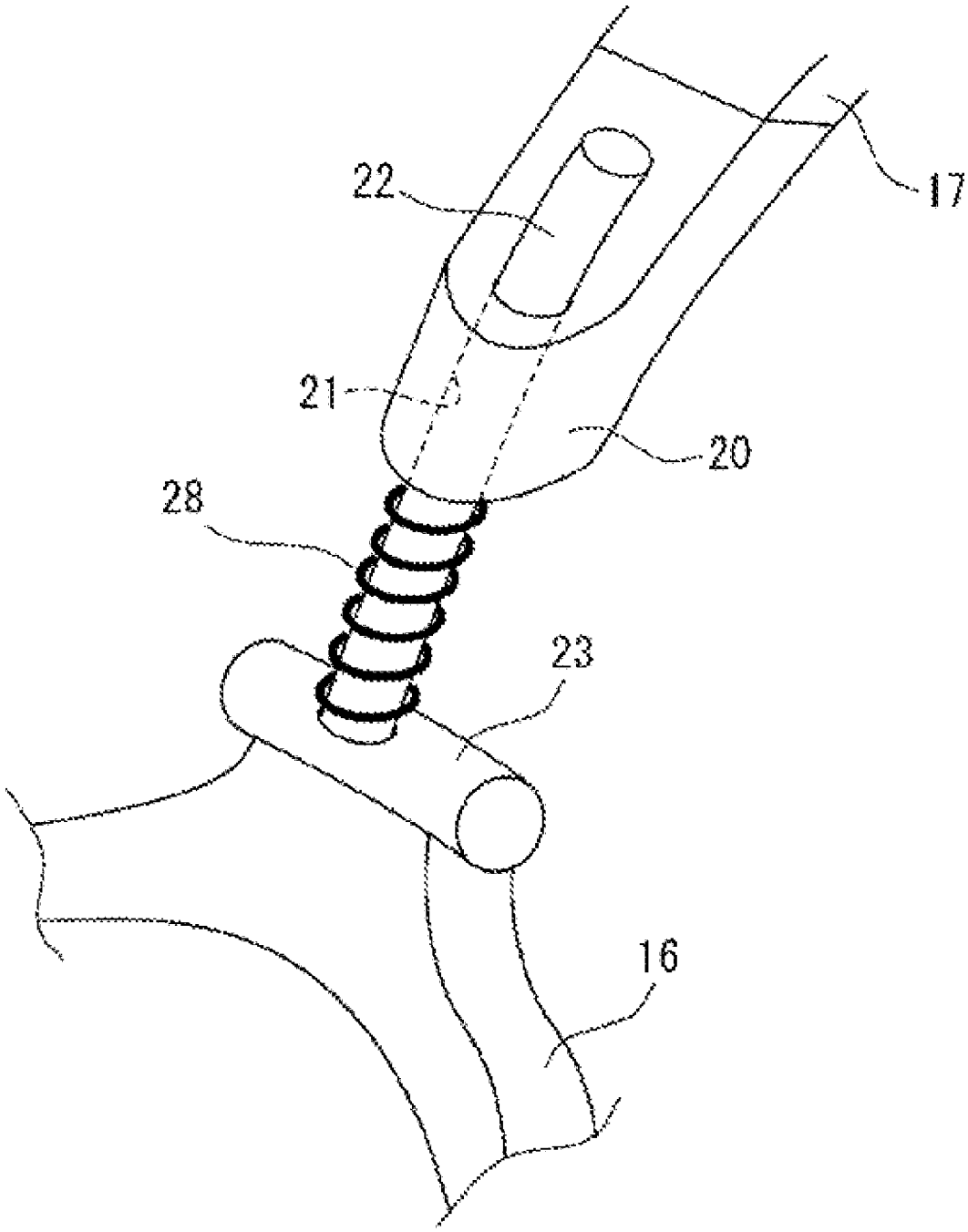
FIG. 16 is a perspective view of a main portion of a sliding mechanism according to a modification.
Figure 17:
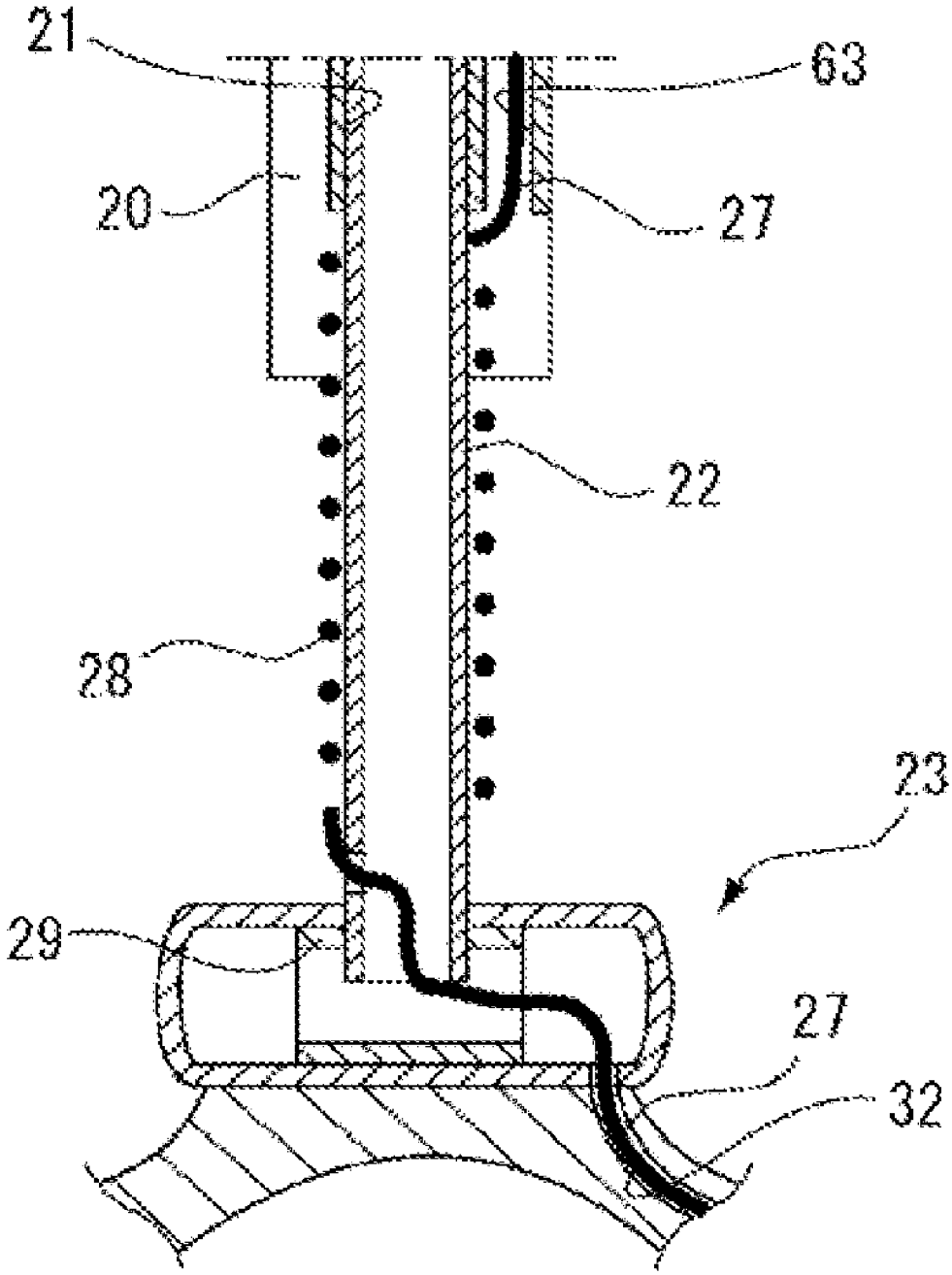
FIG. 17 is an enlarged sectional view of the main portion.

FIGS. 16 and 17 illustrate a modification of the above-described embodiment. Here, instead of the sliders 52 that are bent into U shapes, sliders 22 including relatively large cylindrical members like those according to the first embodiment are used. In addition, each curled portion 28 of the cord 27 is wound upon the corresponding slider 22. Here, the portions of the cord 27 at the upper end sides of the curled portions 28 are drawn out to guide grooves 63 of the slidably supporting portions 20. In contrast, the portions of the cord 27 at the lower end sides of the curled portions 28 pass through the rotating bearings 23 and are disposed in the holding grooves 32 formed inside the respective hangers 16.

Even in such a structure, when performing stretching/compression adjustments in the height direction on the housings 15 with respect to the headband 17, the curled portions 28 of the cord 27, wound upon the sliders 22, are stretched and compressed, so that the height of the cord 27 is adjusted.

Therefore, even in this modification, it is possible to provide operational advantages that are the same are those of the above-described embodiment.

Although, the invention of the application is described with reference to the illustrated embodiments, the invention of the application is not limited to the above-described embodiments, so that various modifications can be made within the scope of the technical ideas of the invention of the application. For example, in the above-described embodiments, the design of the structure in which the sliders and the slidably supporting portions are combined can be varied in various ways.

What is claimed is:

1. A headphone comprising:

a headband; and a left housing and a right housing mounted to respective ends of the headband through respective hangers, each housing accommodating a drive unit, wherein sliders including hollow cylindrical members are mounted to the respective hangers, and are slidably supported at slidably supporting portions at the respective ends of the headband, and wherein a cord, disposed between the left and right housings and used to pass drive electric current to the drive unit in one of the housings, is spirally accommodated in the hollow cylindrical members making up the respective sliders so that the cord is capable of being stretched and compressed, wherein the sliders have draw-out grooves extending in an axial direction thereof, and the spirally accommodated cord is drawn out through the draw-out grooves, and wherein the headband has a holding groove, and wherein first end portions of the cord are drawn out from the draw-out grooves in the slidably supporting portions and are disposed in the holding groove of the headband.

2. The headphone according to claim 1, wherein a lower end portion of each slider is rotatably connected to an upper end of the corresponding hanger by a corresponding bearing, the hangers have holding grooves, and second end portions of the cord are drawn out from inside rotating cylindrical members and are disposed in the holding grooves of the respective hangers, the rotating cylindrical members being mounted to the lower ends of the sliders so as to constitute the bearings and so that axial lines thereof are perpendicular to the sliders.

3. The headphone according to claim 1, wherein each slidably supporting portion has a pawl, wherein the pawls engage the draw-out grooves to prevent rotation of the sliders, and wherein, when the sliders are slid in the respective slidably supporting portions so that a headband-to-hanger distance is reduced, the pawls axially compress the cord spirally accommodated in the sliders.

4. A headphone comprising:

a headband; and a left housing and a right housing mounted to respective ends of the headband through respective hangers, each housing accommodating a drive unit, wherein rod sliders are mounted to the respective hangers, and are slidably supported at slidably supporting portions at the respective ends of the headband, and wherein a cord, disposed between the left and right housings and used to pass drive electric current to the drive unit in one of the housings, is spirally wound upon outer peripheral surfaces of the rod sliders so that the cord is capable of being stretched and compressed, wherein the rod sliders are bent into U shapes, U-shaped bent ends of the respective sliders are slidably supported by the respective slidably supporting portions, each slider has two separated end portions opposite to the corresponding U-shaped bent end, and the two separated end portions of each slider opposite to the corresponding U-shaped bent end are connected to upper ends of the respective hangers.

5. The headphone according to claim 4, wherein upper ends of the cord wound upon the rod sliders are drawn out into the slidably supporting portions, and are stopped at the slidably supporting portions by stopping units.

6. The headphone according to claim 5, wherein the stopping units are stopping pins, and the drawn out cord is bend so as to extend around the stopping pins in the slidably supporting portions.

7. The headphone according to claim 5, wherein the hangers have holding grooves, and lower ends of the cord wound upon the rod sliders are drawn out to draw-out guides and are disposed in the holding grooves of the hangers.

* * * * *